US011224302B2

(12) United States Patent
Jeffs

(10) Patent No.: US 11,224,302 B2
(45) Date of Patent: Jan. 18, 2022

(54) RECEIVING MODULE

(71) Applicant: John Timpson Jeffs, Apple Valley, CA (US)

(72) Inventor: John Timpson Jeffs, Apple Valley, CA (US)

( * ) Notice: Subject to any disclaimer, the term of this patent is extended or adjusted under 35 U.S.C. 154(b) by 82 days.

(21) Appl. No.: 16/691,472

(22) Filed: Nov. 21, 2019

(65) Prior Publication Data

US 2020/0154922 A1 May 21, 2020

Related U.S. Application Data

(60) Provisional application No. 62/770,698, filed on Nov. 21, 2018.

(51) Int. Cl.

| | |
|---|---|
| ***A47G 29/28*** | (2006.01) |
| ***A47G 29/14*** | (2006.01) |
| ***A47G 29/30*** | (2006.01) |
| ***A47G 29/124*** | (2006.01) |
| ***A47G 29/20*** | (2006.01) |
| ***A47G 29/12*** | (2006.01) |

(52) U.S. Cl.

CPC ..... *A47G 29/28* (2013.01); *A47G 29/1251* (2017.08); *A47G 29/12095* (2017.08); *A47G 29/141* (2013.01); *A47G 29/20* (2013.01); *A47G 29/30* (2013.01); *A47G 2029/143* (2013.01); *A47G 2029/145* (2013.01); *A47G 2029/146* (2013.01); *A47G 2029/147* (2013.01)

(58) Field of Classification Search

CPC ..... A47G 29/28; A47G 29/141; A47G 29/30; A47G 29/22; A47G 29/1251; A47G 29/12095; A47G 29/14; A47G 29/16; A47G 2029/143; A47G 2029/145; A47G 2029/146; A47G 2029/147; A47G 2029/148; A47G 29/20; B65F 1/0093; B65F 1/1431; E05G 1/026; B65G 11/04; B65G 11/12; B65G 2201/0285

USPC ..... 232/1 E, 19, 43.5, 44, 45, 51; 109/66; 220/479, 908; 193/8, 33, 34

See application file for complete search history.

(56) References Cited

U.S. PATENT DOCUMENTS

| | | | | |
|---|---|---|---|---|
| 2,781,965 | A | 2/1957 | Dembs | |
| 4,460,222 | A | 7/1984 | Larking | |
| 5,774,053 | A | 6/1998 | Porter | |
| 5,979,750 | A | 11/1999 | Kindell | |
| 6,244,505 | B1 * | 6/2001 | Grimes | A47G 29/1216 232/47 |
| 6,347,737 | B1 * | 2/2002 | Madruga | A47G 29/22 232/34 |

(Continued)

*Primary Examiner* — William L Miller

(74) *Attorney, Agent, or Firm* — Knobbe, Martens, Olson & Bear, LLP

(57) ABSTRACT

A receiving module is disclosed herein. The receiving module can include a body and a door having a front shield and a rear shield coupled to the front shield at an angle. The body of the receiving module can include installation tabs that can include installation plates. The installation plates can be bent and placed against an installation surface to facilitate installation of the receiving module. The receiving module can be coupled to a container that includes a heating compartment and a cooling compartment to store delivered goods or packages in desirable temperature conditions. The receiving module can be modular and attached to different locations.

20 Claims, 12 Drawing Sheets

(56) References Cited

U.S. PATENT DOCUMENTS

| | | | | |
|---|---|---|---|---|
| 6,375,071 | B1 * | 4/2002 | Kim | A47G 29/12095 232/47 |
| 6,378,767 | B1 * | 4/2002 | Steele | A47G 29/22 232/19 |
| 6,484,531 | B1 | 11/2002 | Hambleton et al. | |
| 6,644,543 | B2 * | 11/2003 | Cox | A47G 29/16 232/38 |
| 7,093,747 | B1 * | 8/2006 | Marchese | A47G 29/1216 232/45 |
| 7,320,427 | B2 * | 1/2008 | Prestwich | A47G 29/16 232/45 |
| 7,641,103 | B1 * | 1/2010 | Tomich | F24B 1/199 232/43.4 |
| 9,861,221 | B2 | 1/2018 | Jiang | |
| 10,251,503 | B1 * | 4/2019 | Fulps | A47G 29/12 |
| 10,398,246 | B2 * | 9/2019 | Crooks | A47G 29/22 |
| 10,517,417 | B2 * | 12/2019 | Kutas | A47G 29/1251 |
| 10,799,050 | B1 * | 10/2020 | Glaser | A47G 29/20 |
| 10,881,233 | B1 * | 1/2021 | Walsh | E06B 7/28 |
| 2001/0035703 | A1 | 11/2001 | Schoiefield | |
| 2003/0006275 | A1 | 1/2003 | Gray | |
| 2008/0313054 | A1 | 12/2008 | Lee | |
| 2010/0127063 | A1 * | 5/2010 | Bolles | A47G 29/22 232/39 |
| 2018/0352987 | A1 * | 12/2018 | Kutas | A47G 29/1214 |
| 2019/0282013 | A1 * | 9/2019 | Bolles | A47G 29/1251 |

* cited by examiner

RECEIVING MODULE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

This application relates broadly to devices for receiving delivered packages, and more particularly to modular, adjustable devices for receiving delivered packages.

Description of the Related Art

There are a number of receiving modules (for example, package drop boxes) on the market that receive and securely store packages or other delivered items. However, existing receiving modules have a variety of drawbacks. For example, many of these receiving modules are standalone devices that are often placed outside of a building and therefore do not allow delivered goods or packages to be placed directly inside a secured location (for example, inside a house). Yet another drawback is that these devices are not adjustable once they are installed (for example, through a wall of a house).

SUMMARY

It is, therefore, an object of this invention is to provide a receiving module that can be installed to different types of walls or fences to allow delivered goods or packages to be delivered directly inside a building or a secured location. Additionally, it is an object of the invention for the receiving modules to be easily mountable to different types of walls and be installed at varying depths and angles.

In accordance with one aspect, the receiving module includes a body including one or more installation tabs that allow users to position the receiving module at different installation depth or angle.

In accordance with one aspect, the receiving module can include one or more installation tabs each including an installation plate. The installation plate includes a first plurality of openings that can facilitate installation of the receiving module (for example, to an adjacent wall). Additionally, the installation tabs can include a second plurality of openings that may be different or the same as the first plurality of openings with regards to the size or the shape.

In accordance with one aspect, the installation tabs can each include installation plates that includes one or more cutouts. The cutouts can be formed on edges of the installation plates. The cutouts can reduce the width of the installation plates and facilitate bending of the installation plates.

In accordance with one aspect, the installation tabs may be stand-alone devices that can be incorporated with devices other than the receiving module. The installation tabs can include one or more of the features discussed herein to facilitate installation of devices to various installation surfaces and to control or adjust installation depth.

In accordance with one aspect, the receiving module is coupled to a container including a first compartment for storing packages or goods in a low-temperature environment and a second compartment for storing packages or goods in a high-temperature environment. Temperature settings for the first compartment and the second compartment can be adjusted.

In accordance with one aspect, the receiving module includes a security module that can grant access based on information provided by a delivery person. The information used to authenticate a delivery may include information associated with goods or packages to be delivered. Information associated with the delivery person may be used to authenticate a delivery.

In accordance with one aspect, a modular receiving apparatus for receiving and storing delivered packages is provided. The receiving apparatus can include a body including a first opening. The receiving apparatus can include installation tabs coupled to the body, where each of the plurality of installation tabs include a first plurality of openings to facilitate installation of the modular receiving apparatus. The plurality of installation tabs is bendable at different locations along the plurality of installation tabs to adjust installation depth for the modular receiving apparatus. The receiving apparatus can include a door coupled to the body of the frame. The door can include a front shield and a rear shield, where the rear shield is coupled to the front shield and positioned at a first angle with respect to the front shield. The door can move between a first position and a second position to allow receipt of delivered goods through the first opening.

The plurality of installation tabs may optionally be coupled to side panels of the body. Optionally, the plurality of installation tabs may be formed on the body. The plurality of openings may be circular or elongated. Each of the first plurality of openings may be positioned at a predetermined distance from adjacent openings of the plurality of openings.

Each of the plurality of installation tabs may optionally include a second plurality of openings. The first plurality of openings may optionally formed at a center longitudinal axis of the plurality of installation tabs and the second plurality openings may optionally be offset from the center longitudinal axis of the plurality of installation tabs. The first plurality of openings may optionally be positioned at a first predetermined distance apart from each other, and the second plurality of openings may optionally positioned at a second predetermined distance apart from each other. The first predetermined distance and the second predetermined distance may optionally be the same.

The plurality of installation tabs may optionally be bent such that the first plurality of openings are positioned against a surface for installation. The rear shield may optionally be positioned at a second angle with respect to the first opening to prevent access beyond the rear shield when the door is in the second position.

Each of the plurality of installation tabs may optionally include a plurality of cutouts positioned along edges of the each of the plurality of installation tabs. The plurality of cutouts may optionally facilitate bending of the installation tabs. The plurality of cutouts may optionally be positioned at a predetermined distance apart from each other.

The receiving apparatus may optionally include an authentication module. The authentication module may include a processor, a storage device, and an authentication device. The processor may optionally collect authenticating information associated with packages to be delivered using the authentication device. The storage device may optionally store a set of information associated with expected packages. The processor may optionally compare the authenticating information with the set of information associated with expected packages. Upon determination that the authenticating information matches the set of information associated with expected packages, the processor may optionally unlock the door to allow the door to be moved between the first position and the second position. Upon determination that the authenticating information does not match the set of information associated with expected packages, the processor may optionally prevent the door from moving between the first position and the second position.

In accordance with another aspect, a package receiving container is provided. The receiving container can include a container, a body, a plurality of installation tabs, and a door. The container includes a first opening. The body includes a second opening dimensioned to extend through the first opening. The plurality of installation tabs is coupled to the body, wherein each of the plurality of installation tabs includes a first plurality of openings. The plurality of installation tabs couple the body to the container. The door is coupled to the second opening and include a front shield, a rear shield, and a coupling device. The coupling device rotatably couples the door to the second opening. The rear shield is positioned at a first angle with respect to the front shield. The door rotates between a first position and a second position about the coupling device. The front shield prevents access through the second opening when the door is in the first position. The front shield is angularly positioned away from the opening when the door is in the second position, allowing access through the second opening.

The container may optionally include a first compartment, a second compartment, and a temperature control unit. The second compartment may optionally be physically separated and thermally insulated from the first compartment. The temperature control unit may optionally generate heat for the first compartment and remove heat from the second compartment. The package receiving container may optionally further include and authentication module. The authentication module may optionally include a processor, a storage device, and an authentication device. The processor may optionally collect authenticating information associated with delivered packages using the authentication device. The storage device may optionally store a set of information associated with expected packages. The processor may optionally compare the authenticating information with the set of information associated with expected packages. Upon determination that the authenticating information matches the set of information associated with expected packages, the processor may optionally unlock the door to allow the door to be moved between the first position and the second position. Upon determination that the authenticating information does not match the set of information associated with expected packages, the processor may optionally prevent the door from moving between the first position and the second position.

For purposes of summarizing the disclosure, certain aspects, advantages and novel features are discussed herein. It is to be understood that not necessarily all such aspects, advantages or features will be embodied in any particular embodiment of the invention and an artisan would recognize from the disclosure herein a myriad of combinations of such aspects, advantages or features.

BRIEF DESCRIPTION OF THE DRAWINGS

These and other features, aspects, and advantages of the present disclosure are described with reference to the drawings of certain embodiments, which are intended to schematically illustrate certain embodiments and not to limit the disclosure.

DETAILED DESCRIPTION

Figure 2:
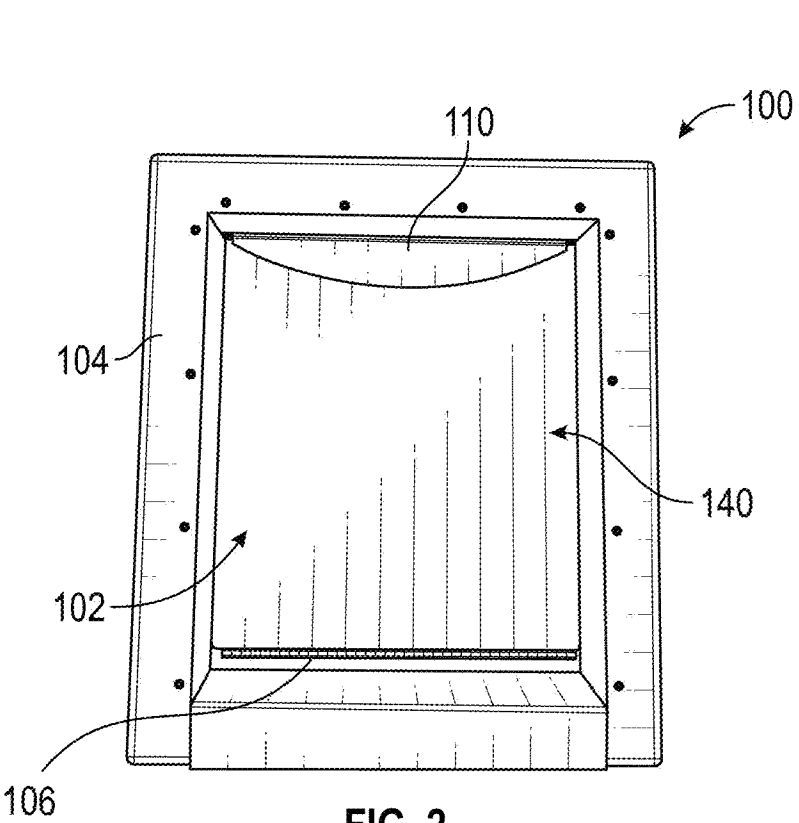
FIG. 2 illustrates a front view of an example receiving module with its door closed.

To facilitate a complete understanding of the disclosure, the remainder of the detailed description references the drawings, wherein like references number are references with numerals throughout. Although certain embodiments and examples are described below, those of skill in the art will appreciate that the disclosure extends beyond the specifically disclosed embodiments and/or uses and obvious modifications and equivalents thereof. Thus, it is intended that the scope of the disclosure herein disclosed should not be limited by any particular embodiments described below.

With reference to FIGS. 1-5, an example embodiment of a receiving module 100 can include a frame 104, a door 102, and a body 108. The body 108 of the receiving module 100 can be formed by one or more plates. The one or more plates can define an opening 140 of the body 108. The shape of the body 108 and the opening 140 can be quadrilateral, circular, oval, hexagonal, triangular, or any adequate shape for facilitating receipt delivered packages of different shapes or sizes. The shapes of the body 108 and the opening 140 may be different. The frame 104 can be coupled to the body 108 and be a part of a front portion of the receiving module 100. The cross-sectional shape of the body 108 and the opening 140 can be the same or different from each other.

Figure 1:
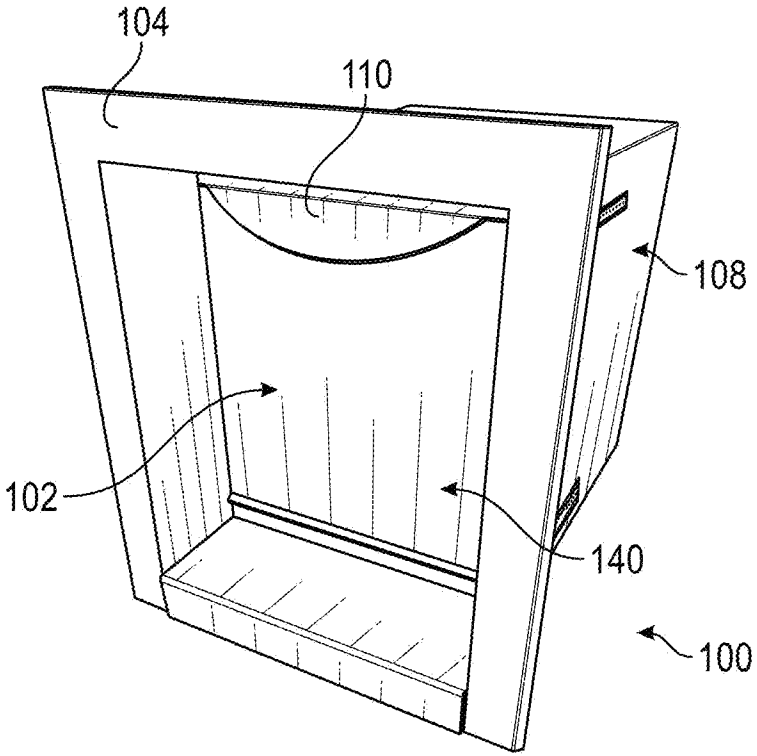
FIG. 1 illustrates a front, isometric view of an example receiving module.
Figure 4:
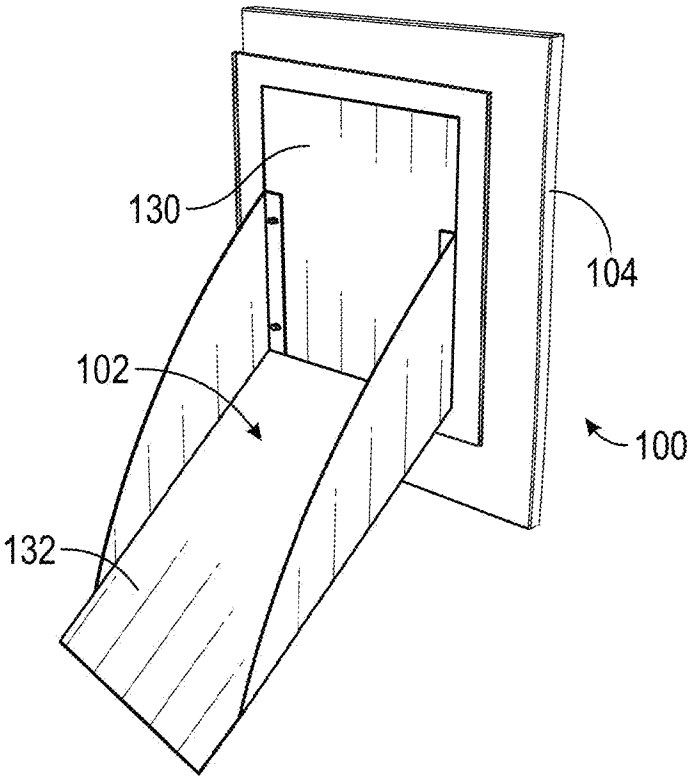
FIG. 4 illustrates a rear, isometric view of another example receiving module.
Figure 3:
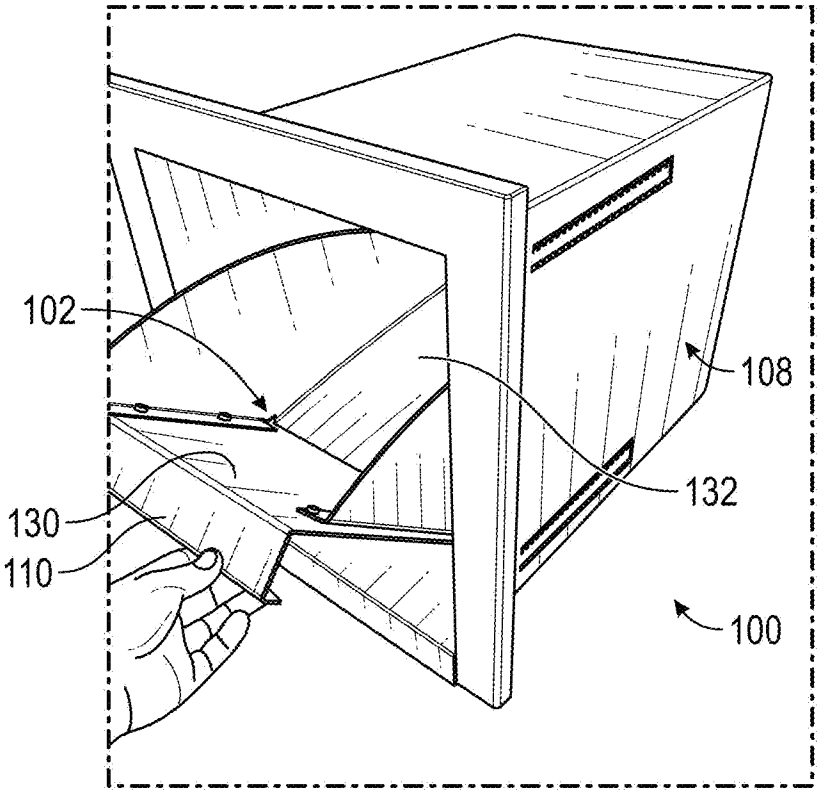
FIG. 3 illustrates a front, isometric view of an example receiving module showing additional detail of the door.

The frame 104 can be a trim coupled to an outer edge of the body 108. Additionally or alternatively, the frame 104 can be coupled to an outer edge of the opening 140. As shown in FIG. 1, the cross-sectional dimension of the frame 104 can be the same or larger than that of the body 108.

The door 102 can be coupled to one of the sides of the body 108. The door 102 may be coupled to an inside or outside surface of the opening of the body 108. The receiving module 100 can include a hinge 106 coupled to the door 102 that allows the door 102 to rotate between a first position and a second position. In the first position, the door 102 can be closed to prevent delivery of packages through the receiving module 100. In the second position, the door 102 can be open to allow delivery of packages through the receiving module 100.

The door 102 can include a front shield 130 and a rear shield 132. The front shield 130 can be in substantially orthogonal to the opening 140 when the door 102 is in the first position (for example, the closed position). When the door 102 is in the second position (for example, the open position), a front shield 130 of the door 102 may be at an angle with respect to the position associated with the first position. In some aspects, the front shield 130 may be about 90 degrees with respect to the opening 140 when the door 102 is in the first position. When the door 102 is in the second position, the angle between the front shield 130 and the front shield 130 in the closed position may be between about 30 degrees and about 90 degrees, between about 35 degrees and about 85 degrees, between about 40 degrees and about 80 degrees, between about 45 degrees and about 75 degrees, between about 50 degrees and about 70 degrees, between about 55 degrees and about 65 degrees, or about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, or between a range of any two of aforementioned values.

The front shield 130 can create a seal with the body 108. The seal between the front shield 130 and the body 108 can be waterproof to prevent water from entering through the receiving module 100. Additionally or alternatively, portions of the body 108 can be sloped downwards to reduce the likelihood of water entering through the receiving module 100.

The front shield 130 and the rear shield 132 can be coupled to each other at an angle. The angle between the front shield and the rear shield can vary between about 90 degrees and about 160 degrees, between about 100 degrees and about 140 degrees, and between about 110 degrees and about 120 degrees, or about 90 degrees, 100 degrees, 110 degrees, 120 degrees, 130 degrees, 140 degrees, 150 degrees, 160 degrees, or between a range of any two of the aforementioned values.

The orientation of the front shield 130 and the rear shield 132 can advantageously allow the rear shield 132 to prevent a person from outside (for example, delivery person) from looking inside to see or access other delivered items or other items located within a secured location (for example, inside a house, a garage, a shed, a column of a building). When the door 102 is in an open position, the rear shield 132 may move upward and hide the stored packages from the view, preventing people from seeing what package(s) have been delivered. Additionally, because the rear shield 132 moves up as the door 102 moves to its open position, it may block (fully or partially) the opening 140 and prevent people from trying to access and grab the already delivered packages.

When the door 102 is in the first position (that is, open position), a delivered package can be placed within the body 108 of the receiving module 100. The rear shield 132 can hold delivered packages while the door 102 is in the first position (that is, opened position). When the door 102 is moved from the first position to the second position (that is, closed position), the rear shield 132 can be positioned downward to allow delivered packages to slide and fall into a storage device located beyond the receiving module 100 (see FIG. 3).

Figure 6:
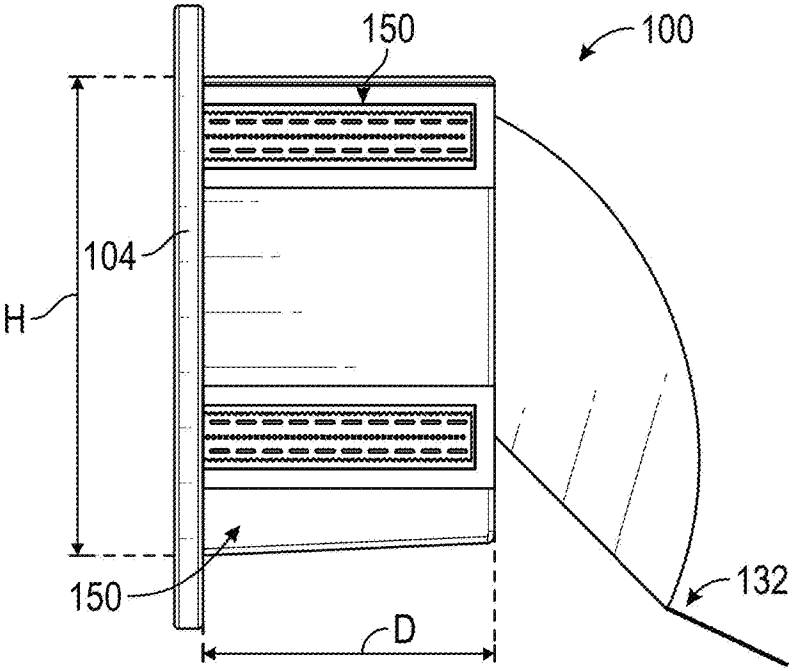
FIG. 6 illustrates a side view of another example receiving module.
Figure 5:
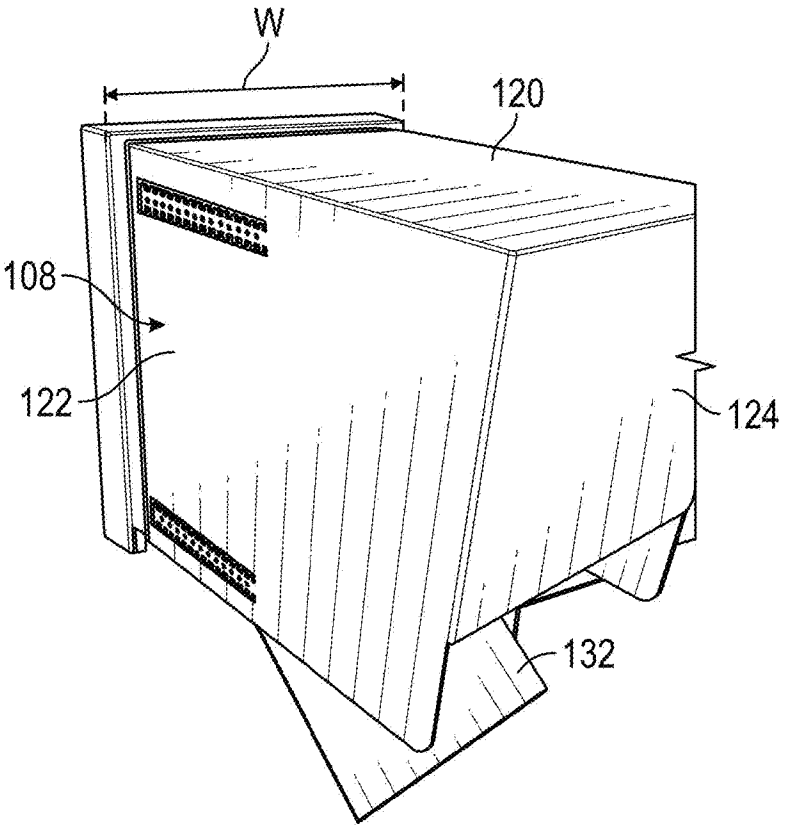
FIG. 5 illustrates a rear, isometric view of an example receiving module.
Figure 8:
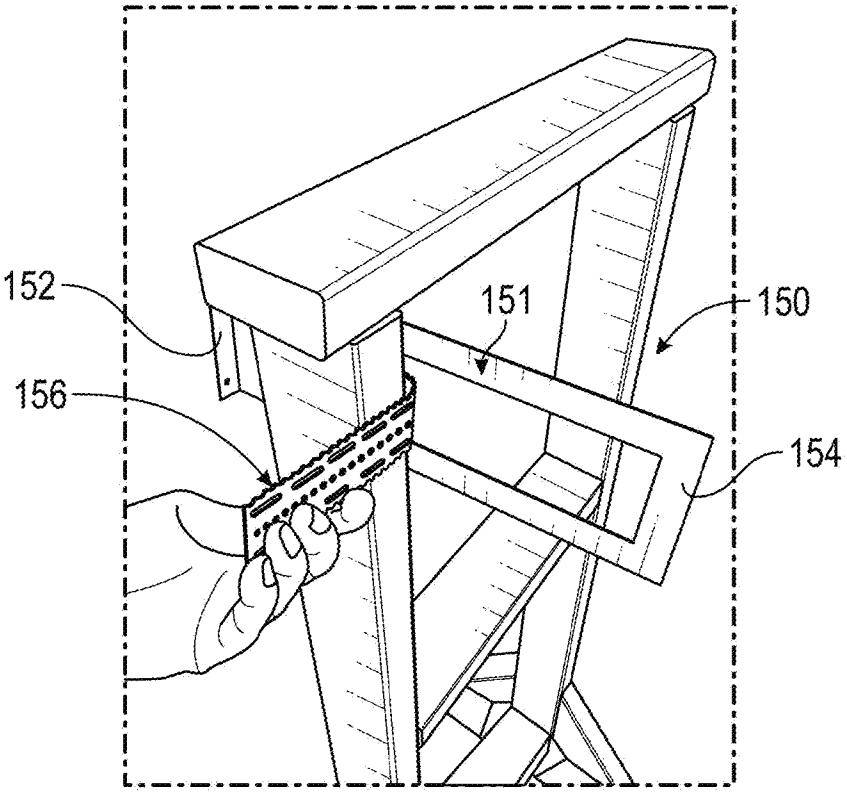
FIG. 8 illustrates an example installation tab positioned against an installation surface.
Figure 7:
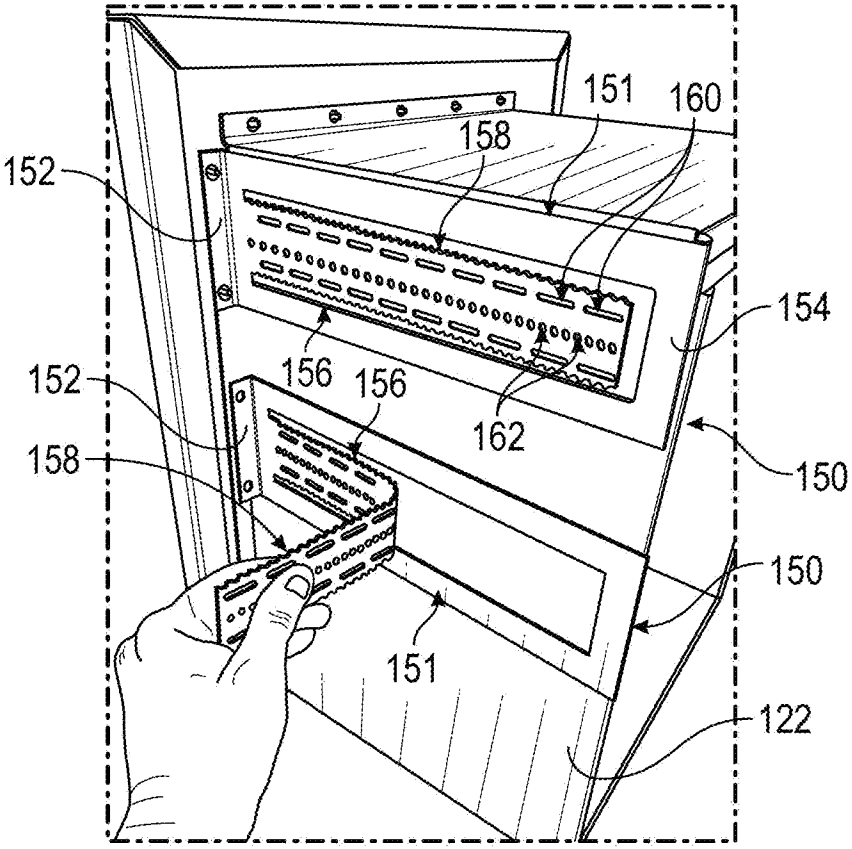
FIG. 7 illustrates various orientations of an example installation tab.
Figure 9A:
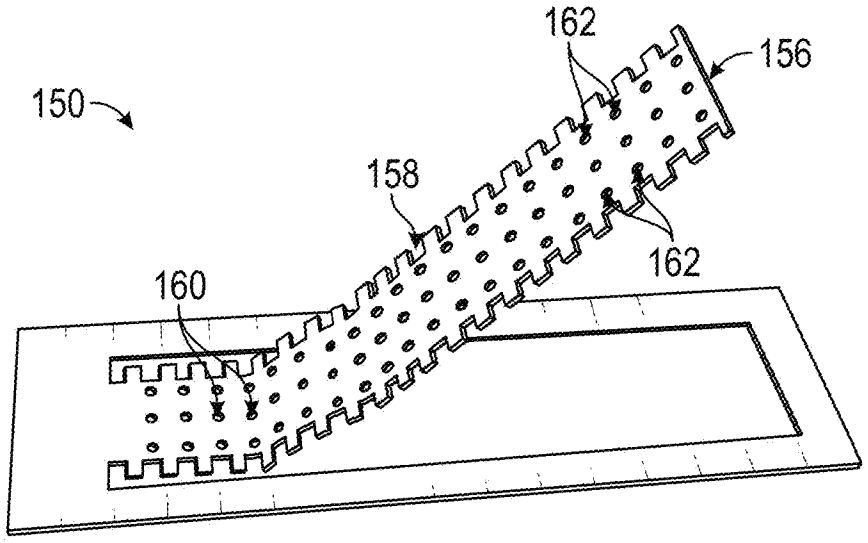
FIGS. 9A-9D illustrate different embodiments of the installation tab.
Figure 9B:
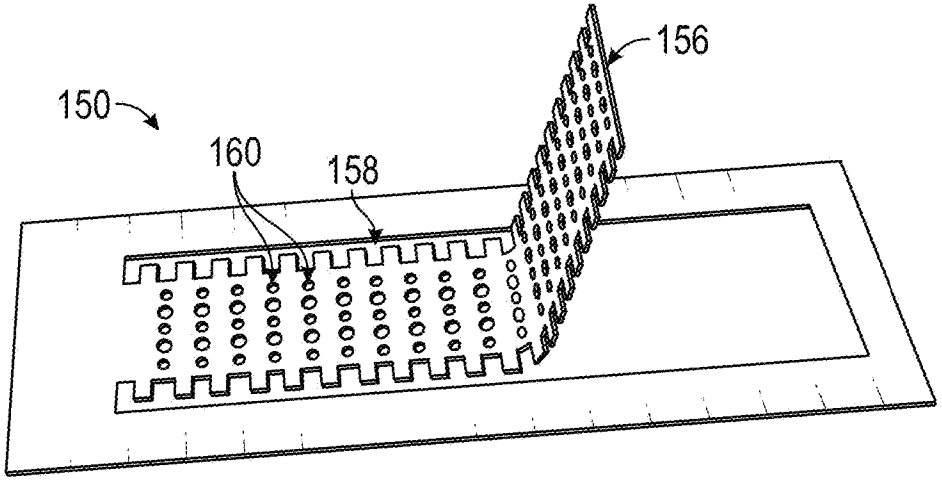
Figure 9D:
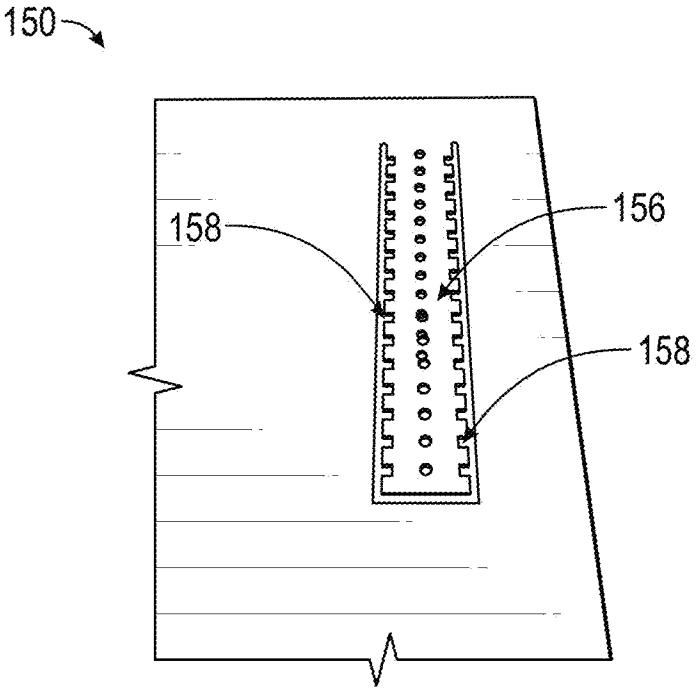
Figure 9C:
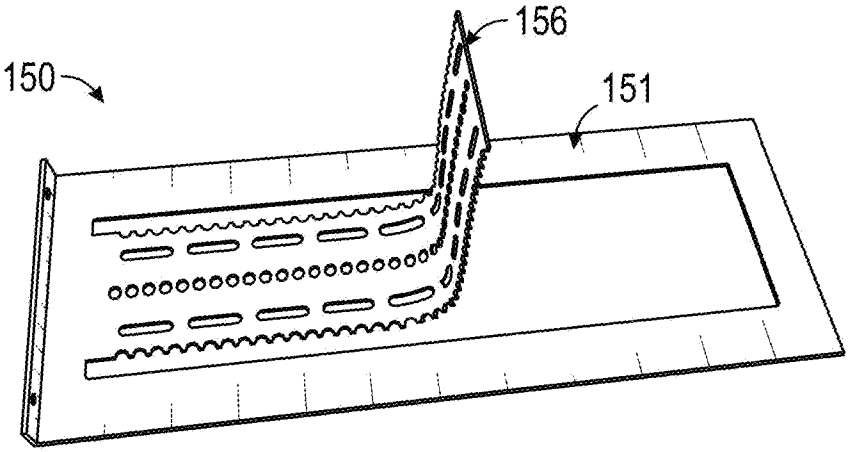

The door 102 can include a handle 110 can allows users to move the door 102 from the first position to the second position, and vice versa. The handle 110 can be coupled to the front shield 130 as shown in FIG. 6. The handle 110 can be coupled at different locations. For example, the handle 110 can be coupled at a top edge of the front shield 130. In some examples, the handle 110 can be coupled at side edges, bottom edge, or substantially at the middle of the front shield 130.

The body 108 can include one or more side panels 122, a rear panel 124, and a top panel 120. Any one of the side panels 122, the rear panel 124, and the top panel 120 may be optional. In some embodiments, the receiving module 100 may not include the body 108. The frame 104 may be coupled to a wall of a house or a building without the body 108.

The height, depth, and width of the receiving module 100 may vary. The height and width of the receiving module 100 may be substantially the same as the height and the width of the opening 140. The height (H) of the receiving module 100 can be between about 5 inches and about 30 inches, between about 10 inches and about 25 inches, between about 15 inches, and about 20 inches, or about 5 inches, 10 inches, 15 inches, 20 inches, 25 inches, 30 inches, or between a range of any two aforementioned values. The width (W) of the receiving module 100 can be between about 5 inches and about 50 inches, between about 10 inches and about 45 inches, between about 15 inches and about 40 inches, between about 20 inches and about 35 inches, between about 25 inches and about 30 inches, or about 5 inches, 10 inches, 15 inches, 20 inches, 25 inches, 30 inches, 35 inches, 40 inches, 45 inches, 50 inches, or between a range of any two of aforementioned values. The depth (D) of the receiving module 100 can be between about 5 inches and about 40 inches, between about 10 inches and about 35 inches, between about 15 inches and about 30 inches, between about 20 inches and about 25 inches, or about 5 inches, 10 inches, 15 inches, 20 inches, 25 inches, 30 inches, 35 inches, 40 inches, or between a range of any two of aforementioned values.

With reference to FIGS. 6-9D, the receiving module 100 can include one or more installation tabs 150. The installation tab 150 can be used to facilitate installation of the receiving module 100. The installation tab 150 may be a separate device coupled to the sides (for example, the side panels 122) of the body 108 of the receiving module 100. In some aspects, the installation tab 150 may be formed on the sides (for example, the side panels 122) of the body 108.

The installation tabs 150 can include a bracket 151 and installation plate 156. The bracket 151 of the installation tabs 150 may be affixed to the sides of the body 108 of the receiving module 100. The bracket 151 can include a proximal end 152 and a distal end 154, where the proximal end 152 can be positioned about a front portion of the receiving module 100 near the frame 104. The installation plate 156 may be coupled to the proximal end 152 or the distal end 154 of the bracket 151.

In some examples, the bracket 151 of the installation tabs 150 may be optional. As discussed herein, the installation tabs 150 may be formed on the sides (for example, the side panels 122) of the body 108 such that brackets 151 are not needed.

Different portions of the installation plate 156 can be coupled to the bracket 151. One or more sides of the installation plate 156 can be coupled to the bracket 151. Having only one side of the installation plate 156 coupled to be bracket 151 can advantageously allow the installation plate 156 to be bent with respect to the installation tab 150. When the installation plate 156 is bent, a first portion of the installation plate 156 may remain substantially parallel to the body 108 of the receiving module 100 while a second portion is bent at an angle. In a non-limiting example shown in FIG. 9, the second portion may be bent at approximately 90 degrees with respect to the first portion. The second portion can be placed or positioned against a wall for installation.

The installation plate 156 can bent at different angles for different installation situations. Depending on the orientation of installation surface, the installation plate 156 can be bent to accommodate the installation surface orientation. A user may wish to install the receiving module 100 at an angle other than 90 degrees with respect to a wall. For example, the user may wish to install the receiving module 100 such that a first side of the body 108 is at about 45 degrees with respect to the wall and a second side of the body 108 is at about 135 degrees with respect to the wall. In this non-limiting example, the installation plate 156 can be bent at about 45 degrees and about 135 degrees to facilitate installation of the receiving module 100. The installation plate 156 can be bent at other angles to allow the receiving module 100 to be installed at different orientations.

Additionally, the installation plate 156 may be bent at different locations. This allows installation depth of the receiving module 100 to be adjustable. This can be advantageous in facilitating installation of the receiving module 100 on walls with different thicknesses.

The installation plate 156 can include a first set of openings 162 positioned along the length of the installation plate 156. The first set of openings 162 can be positioned about a center axis parallel to the length of the installation plate 156. Screws can be inserted through the first set of openings 162 to affix the installation tab 150 to a surface for installing the receiving module 100. The first set of openings 162 can be circular, square, rectangular, or any other suitable shapes to allow different types of screws to extend through.

Additionally or alternatively, the installation plate 156 can include a second set of openings 160 that are positioned about the edges of the installation plate 156. The second set of openings 160 can be positioned offset from the center axis of the installation plate 156. The second set of openings 160 can be offset at a predetermined distance from the center axis. Screws can be inserted through the second set of openings 160 to affix the installation tab 150 to a surface for installing the receiving module 100. The second set of openings 160 can be circular, square, rectangular, or any other suitable shapes to allow different types of screws to extend through. The shape of the second set of openings 160 can be different or the same as that of the first set of openings 162.

As discussed herein, some of the openings formed on the installation plate 156 may be elongate. Those elongated openings may extend along an axis parallel to the length or the width of the installation plate 156. Openings extending along an axis parallel to the length of the installation plate 156 can allow horizontal movement of the receiving module 100 during installation. On the other hand, openings extending along an axis parallel to the width of the installation plate 156 can allow vertical movement of the receiving module 100 during installation. As such, elongated openings can allow the position of the receiving module 100 during installation, which can allow accurate positioning of the receiving module 100. In some aspects, the installation plate 156 can include both the openings extending along an axis parallel to the width of the installation plate 156 and the openings extending along an axis parallel to the length of the installation plate 156. Additionally or alternatively, the installation plate 156 can include elongated openings extending at about 45 degrees with respect to either the width or the length of the installation plate 156. Such elongated openings can allow simultaneous vertical and horizontal shift in position of the receiving module 100.

Additionally or alternatively, the installation plate 156 can include a set of cutouts 158 formed on the edges of the installation plate 156. The set of cutouts 158 can be positioned along the length of the installation plate 156. The cutouts 158 can be in different shapes including, but not limited to, semi-circular, triangular, square, rectangular, or the like. The cutouts 158 can effectively reduce the width of the installation plate 156 at various locations along the length of the installation plate 156. This can be advantageous in making the installation plate 156 easier to bend at locations where the cutouts 158 are present.

Additionally, the distance between each adjacent set of cutouts 158 can remain the same or vary along the length of the installation tab 156.

The openings can be positioned such that each adjacent openings are spaced apart at a predetermined distance from each other. Similarly, the cutouts can be positioned such that each adjacent cutouts are spaced apart at another predetermined distance from each other. The predetermined distance between each adjacent openings and the predetermined distance between each adjacent cutouts can be the same or different. In this regard, the positions of the openings or cutouts can be associated with locations along the installation plate 156 at which the installation plate 156 can be bent.

FIGS. 9A-9D can show different examples of the installation plate 156. The number of the openings, positions of the openings, shapes of the openings, or dimensions of the openings may be varied to vary the flexibility of the installation plate 156 and accommodate different sizes of screws used for installation of the receiving module 100. Additionally or alternatively, the orientations of the cutouts can vary. Depth of the cutouts 158 can vary to modify flexibility of the installation plate 156.

The width or the length of the installation plate 156 can be varied. The width of the installation plate 156 can be between about 0.5 inches and about 5 inches, between about 1 inch and about 4.5 inches, between about 1.5 inches, and about 4 inches, between about 2 inches and about 3.5 inches, between about 2.5 inches and about 3 inches, or about 0.5 inches, 1 inch, 1.5 inches, 2 inches, 2.5 inches, 3 inches, 3.5 inches, 4 inches, 4.5 inches, 5 inches, or between a range of any two of aforementioned values. The length of the installation plate 156 can be between about 5 inches and about 40 inches, between about 10 inches and about 35 inches, between about 15 inches, and about 30 inches, between about 20 inches and about 25 inches, or about 5 inches, 10 inches, 15 inches, 20 inches, 25 inches, 30 inches, 35 inches, 40 inches, or between a range of any two of aforementioned values. It is contemplated that the width of the installation plate may be less than 0.5 inches or greater than 5 inches. Additionally, it is contemplated that the length of the installation plate may be less than 5 inches or greater than 40 inches. Suitable dimensions may be chosen based at least in part on the weight of the receiving module 100, sizes of expected packages to be received, installation depth of the receiving module 100, amount of installation surface available (that is, area on a wall available for the installation plate 156 to be placed against).

Additionally or alternatively, the thickness of the installation plate 156 can be varied. The thickness of the installation plate 156 can be between about 0.01 inches and about 0.25 inches, between about 0.05 inches and about 0.2 inches, between about 0.1 inches, and about 0.15 inches, or about 0.01 inches, 0.05 inches, 0.1 inches, 0.15 inches, 0.2 inches, 0.25 inches, or between a range of any two of aforementioned values. It is contemplated that the thickness of the installation plate can be less than 0.01 inches or greater than 0.25 inches in some examples. As discussed herein, suitable thickness may be chosen for different situations.

It is contemplated that the installation tabs 150 may be stand-alone devices that can be incorporated with devices other than the receiving module 100. The installation tabs 150 can include one or more of the features (for example, the bracket 151, the installation plate 156, the openings 160, the openings 162, and the cutouts 158) discussed herein to facilitate installation of devices to various types of installation surfaces and to control or adjust installation depth.

With reference to FIGS. 10-14, an example embodiment of a container 200 includes a first compartment 202, a second compartment 204, a separator 206, and a temperature control unit 220. The first compartment 202 and the second compartment 204 may be separated by the separator 206. The separator 206 may include one or more layers of insulation to reduce thermal conductivity through the separator 206. In this regard, the separator 206 can reduce the amount of thermal energy transmitted between the first compartment 202 and the second compartment 204.

The temperature of the first compartment 202 may be kept below a first predetermined temperature. The first predetermined temperature associated with the first compartment 202 may be between about 15 degrees Fahrenheit and about 50 degrees Fahrenheit, between about 20 degrees Fahrenheit and about 45 degrees Fahrenheit, between about 25 degrees Fahrenheit and about 40 degrees Fahrenheit, between about 30 degrees Fahrenheit and about 35 degrees Fahrenheit, or about 15 degrees Fahrenheit, 20 degrees Fahrenheit, 25 degrees Fahrenheit, 30 degrees Fahrenheit, 35 degrees Fahrenheit, 40 degrees Fahrenheit, 45 degrees Fahrenheit, 50 degrees Fahrenheit, or between a range of any two of the aforementioned values. The temperature of the first compartment 202 may be suitable to store goods (e.g., in a cooled or refrigerated state) and prevent goods (for example, grocery) from spoiling until picked up.

The temperature of the second compartment 204 may be kept above a second predetermined temperature. The second predetermined temperature associated with the second compartment 204 may be between about 100 degrees Fahrenheit and about 200 degrees Fahrenheit, between about 110 degrees Fahrenheit and about 190 degrees Fahrenheit, between about 120 degrees Fahrenheit and about 180 degrees Fahrenheit, between about 130 degrees Fahrenheit and about 170 degrees Fahrenheit, between about 140 degrees Fahrenheit and about 160 degrees Fahrenheit, or about 100 degrees Fahrenheit, 110 degrees Fahrenheit, 120 degrees Fahrenheit, 130 degrees Fahrenheit, 140 degrees Fahrenheit, 150 degrees Fahrenheit, 160 degrees Fahrenheit, 170 degrees Fahrenheit, 180 degrees Fahrenheit, 190 degrees Fahrenheit, 100 degrees Fahrenheit, or between a range of any two of the aforementioned values. The temperature of the second compartment 204 may be suitable to keep goods (for example, cooked food, such as pizza, wings, or the like) warm or hot until picked up.

The temperature control unit 220 can include a processor 222, a storage device 224, and a temperature sensor 226. The storage device 224 can include data associated with temperature thresholds for the first compartment 202 and the second compartment 204. The processor 222 can use the temperature sensor 226 to measure the temperature of the first compartment 202 and the second compartment 204 and compare the temperatures to the temperature threshold values. Based at least in part on the comparison of the measured temperature values of the first compartment 202 and the second compartment 204 and the temperature threshold values, the processor 222 may control operation of the temperature control unit 220 to adjust or not adjust the temperatures of the first compartment 202 and the second compartment 204. A user of the receiving module 100 and the container 200 may modify the threshold temperature values for the first compartment 202 and the second compartment 204.

Additionally, the temperature control unit 220 can include a fluid conduit system 228. The conduit system 228 can direct flow of fluid used to transmit thermal energy. In a non-limiting example, the conduit system 228 can direct a flow of hot fluid into the walls (e.g., into a channel of the walls) of the second compartment 204 and direct a flow of cold fluid into the walls (e.g., into a channel in the walls) of the first compartment 202. In some aspects, a portion of the conduit system 228 can be installed within the separator 206. Additionally or alternatively, a portion of the conduit system 228 can be installed within side walls of the compartments 202 and 204. Although the non-limiting example of the container 200 portrays the conduit 228 extending vertically between a bottom portion and a top portion of the container 200, it is contemplated that different configurations or orientations of the conduit 228 adequate to direct flow of heat transfer fluid between or to the first compartment 202 and the second compartment 204 can be used.

The temperature control unit 220 may be installed below the first compartment 202. The temperature control unit 220 can include one or more blowers, one or more condensers, one or more evaporators, one or more compressors, one or more expansion valves, and one or more fans to keep the temperature of the first compartment 202 below the first predetermined temperature and the temperature of the second compartment 204 above the second predetermined temperature. In another implementation, the temperature control unit 220 can circulated heated or cooled air in one or both of the compartments 202, 204 to heat or cool the compartment 202, 204.

The temperature control unit 220 can be used to remove thermal energy from the first compartment 202 and to provide thermal energy to the second compartment 204. The fans or blowers of the temperature control unit 220 may facilitate removal or addition of thermal energy to the first compartment and the second compartment by circulating cooled or heated air through the first compartment 202 or the second compartment 204, respectively.

In some aspects, separate temperature control units 220 may be provided to the first compartment 202 and the second compartment 204. A temperature control unit 220 for the first compartment 202 can remove thermal energy from the first compartment 202 and lower the temperature of the first compartment 202. A temperature control unit 220 for the second compartment 204 can remove thermal energy from the second compartment 2024 and lower the temperature of the second compartment 204.

As shown in FIGS. 10-15, the first compartment 202 may be positioned below the second compartment 204. Alternatively, the first compartment 202 may be positioned above the second compartment 204.

It is contemplated that the cold temperature of the first compartment 202 may generate condensation near the first compartment 202. In some aspects, the container 200 can include a collection pan to collect the condensation. For example, the collection pan can be positioned under the first compartment 202. The collection pan may include a drain to remove the condensation from the collection pan.

Figure 11:
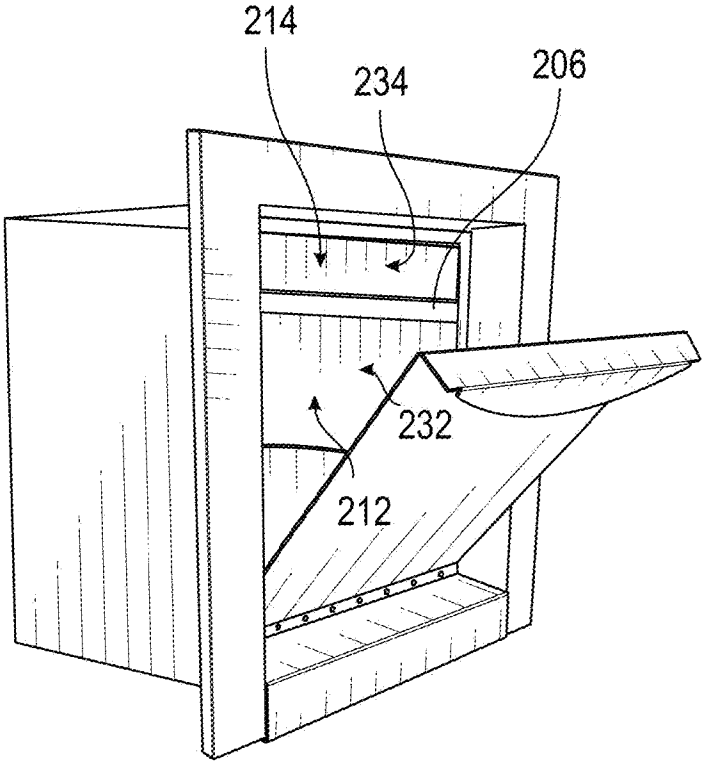
FIG. 11 illustrates a front isometric view showing a door of the secure container of FIG. 10 in an open position.
Figure 10:
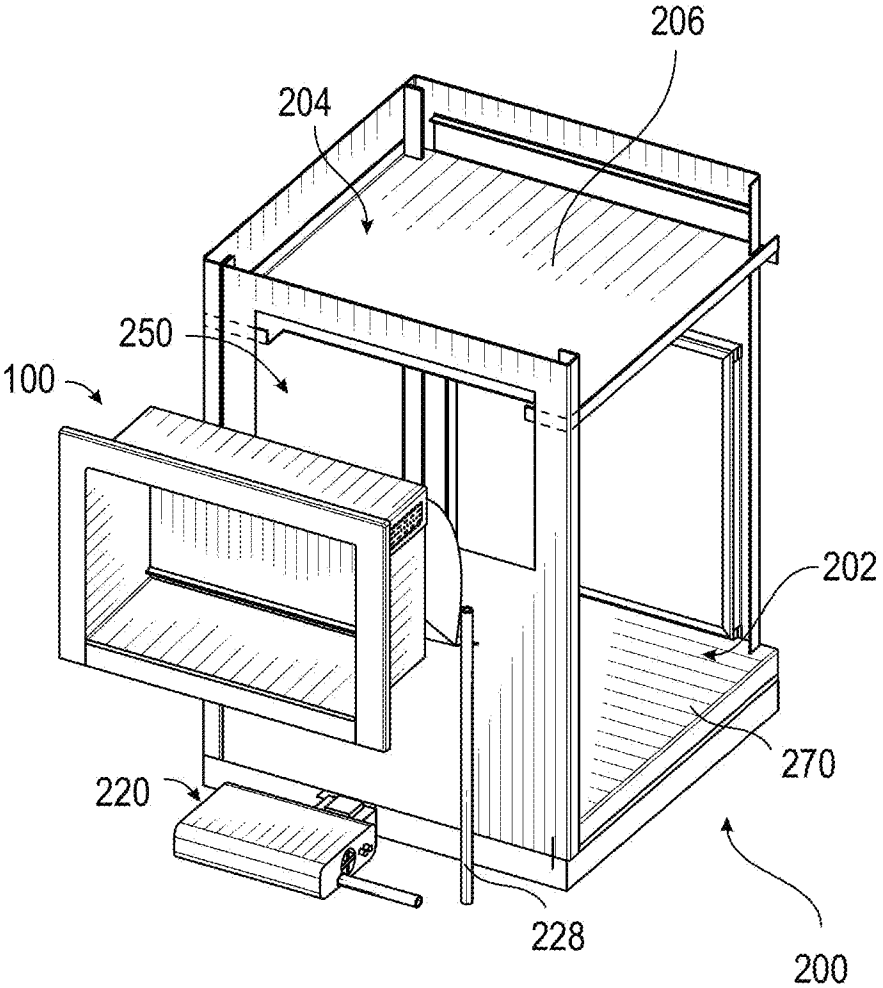
FIG. 10 illustrates an exploded view of a secured container with an example receiving module.

When the door 102 is in the open position, a user may have an access to an opening 212 to the first compartment 202 and an opening 214 to the second compartment 204, as shown in FIG. 11. The opening 212 may be smaller than the opening 214. In some examples, the opening 212 may be bigger than or the same size as the opening 214. The opening 212 of the first compartment 202 may include a door 232. The opening 214 of the second compartment 204 may include a door 234. The door 232 and door 234 may be insulated to prevent thermal energy transmission between the atmosphere and the first compartment 202 and between the atmosphere and the second compartment 204. The doors 232 and 234 for the first compartment 202 and the second compartment 204 may be optional.

The container 200 can be coupled to the receiving module 100. The container 200 can include an opening 250 dimensioned to receive the receiving module 100. The cross-sectional shape of the receiving module 100 may be the same as the shape of the opening 250 to allow the opening 250 to mate with the receiving module 100. In some aspects, the receiving module 100 may be integrated with the container 200.

Figure 12B:
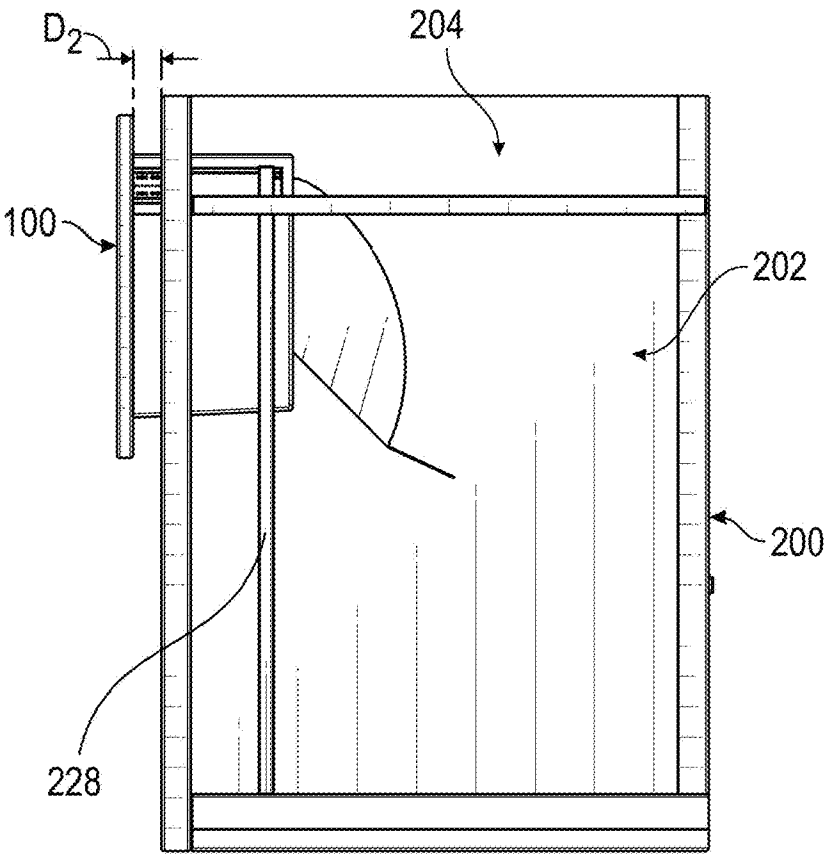
FIGS. 12A and 12B illustrate side views of the secure container of FIG. 10, with its side panel removed to show different components of the secure container.
Figure 12A:
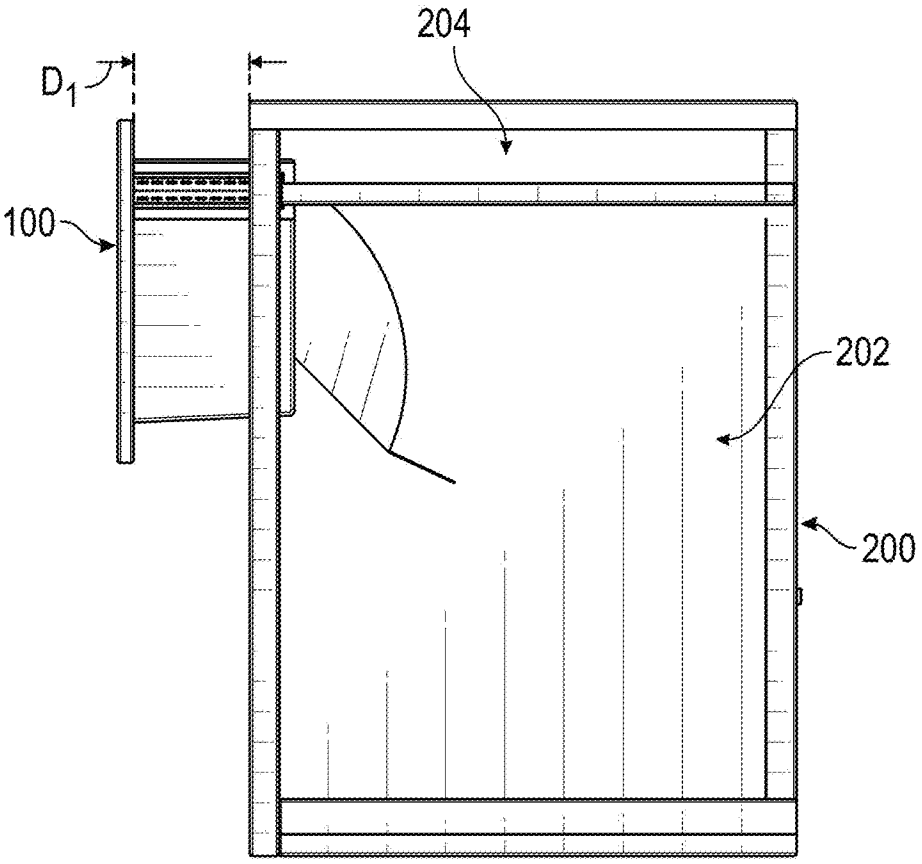
Figure 14:
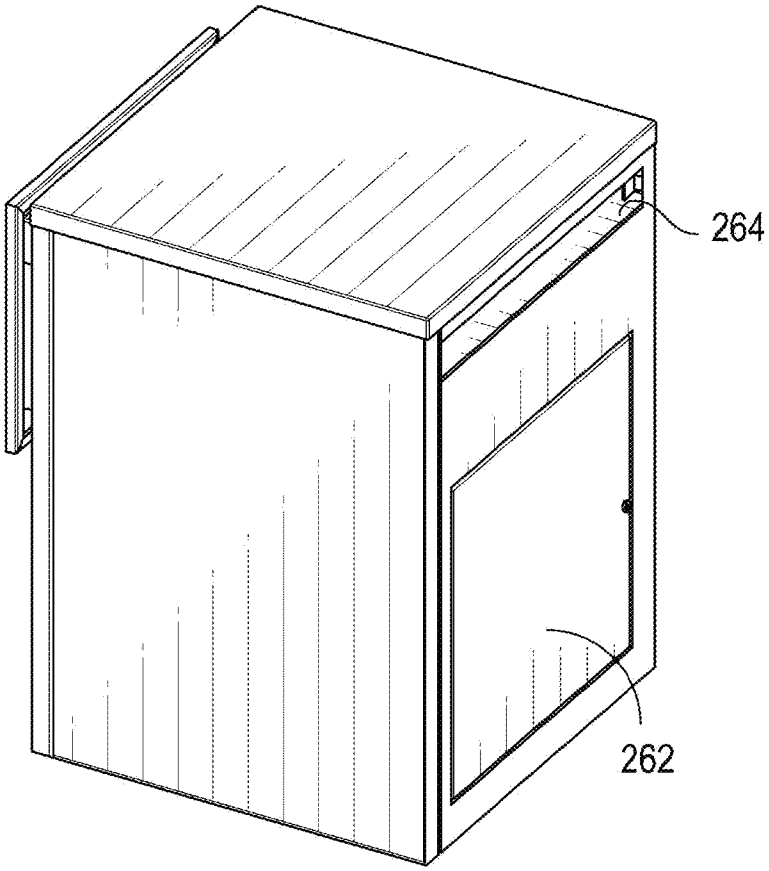
FIGS. 14 and 15 illustrate rear, isometric views of the secure container of FIG. 10, showing different locations for doors providing access to the secure container.
Figure 13:
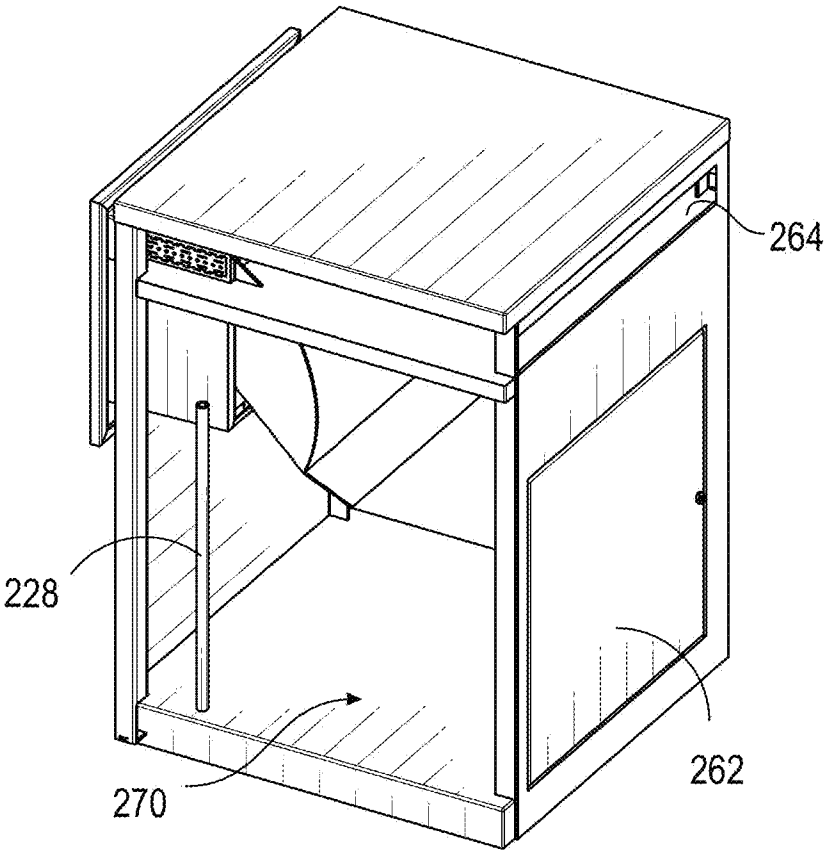
FIG. 13 illustrates a rear, isometric view of the secure container of FIG. 10, with its side panel removed to show different components of the secure container.
Figure 15:
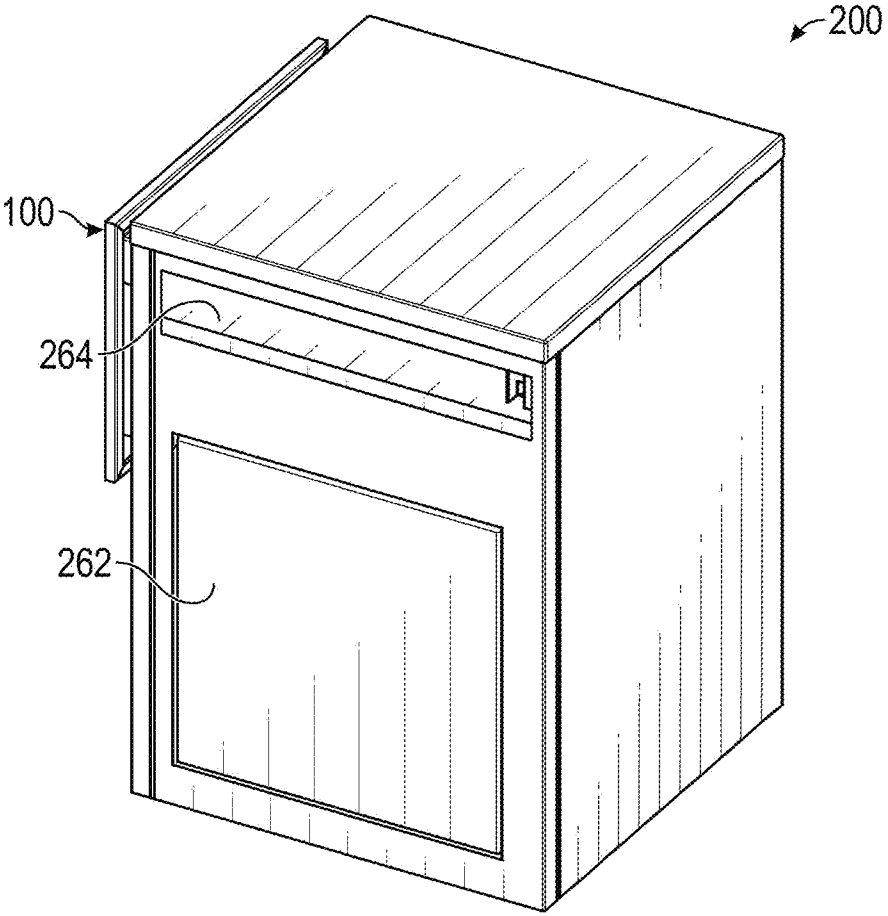
Figure 16:
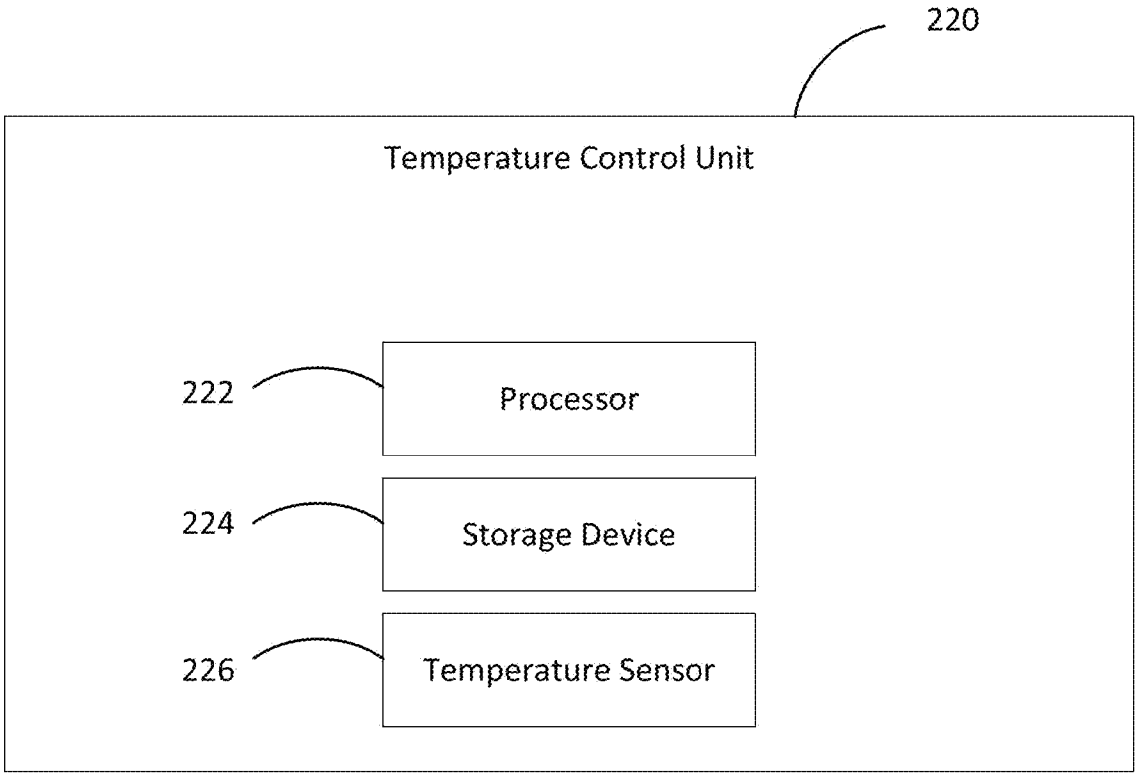
FIG. 16 illustrates a schematic diagram of a temperature control unit.
Figure 17:
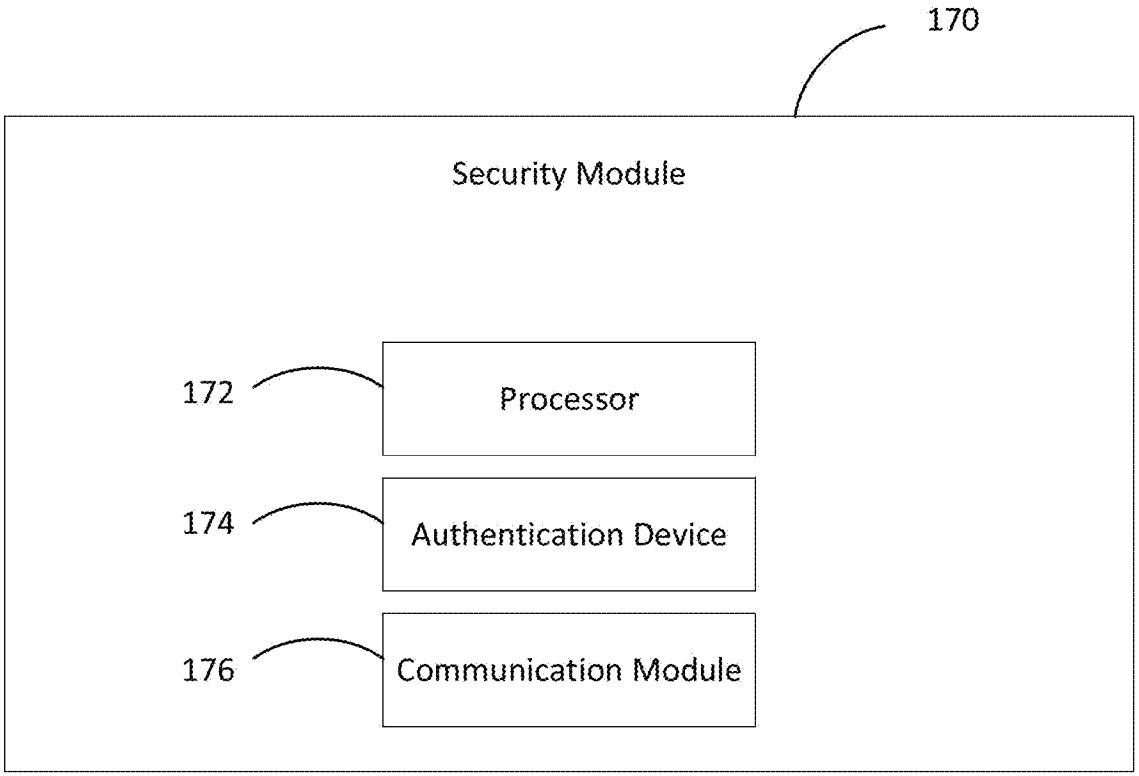
FIG. 17 illustrates a schematic diagram of a security module.

The receiving module 100 may be coupled to the container 200 at different installation depths. As shown in FIGS. 12A and 12B, the distance between the frame 104 of the receiving module 100 and the container 200 (for example, D1 and D2) may be varied. The installation depth can be varied using the installation tabs 150 and installation plates 156. As discussed herein, the installation plates 156 can be reshaped (for example, bent) so that it can be coupled to the sides of the container 200. The installation plates 156 can be bent at different locations to provide different installation depth for the receiving module 100.

Additionally, the container 200 can include an opening 262 and an opening 264 to provide user access to the container 200. The opening 262 can be associated with the first compartment 202 and the opening 264 can be associated with the second compartment 204. The openings 262 and 264 each may include a door that can be insulated to prevent thermal energy transmission from the first compartment 202 and the second compartment 204, respectively. The doors for the openings 262 and 264 may include a locking device. The openings 262 and 264 may be positioned at different locations of the container 200. For example, one of the openings 262 and 264 may be positioned at a side of the container 200 and another one of the openings 262 and 264 may be positioned at the rear side of the container 200. Optionally, the openings 262 and 264 may be positioned on the same sides of the container 200.

The first compartment 202 may include an adjustable floor 270 that may include dampening elements to break the impact on delivered goods when dropped into the first compartment 202. The dampening element may be a set of springs installed below the adjustable floor 270. In some examples, the dampening element may be a set of springs positioned between the separator 206 and the adjustable floor 270.

The container 200 can be a standalone device that may be modular in construction. In this regard, the container 200 may be placed at any desired location. Alternatively, the container 200 can be coupled to walls. This can be advantageous to allow delivered packages to be stored within a secured location. In some examples, the container 200 is housed inside a building (for example, a house) positioned next to a wall. An aperture may be formed on the wall to allow the receiving module 100 to be installed through the wall and coupled to the opening 250 of the container 200.

The receiving module 100 may include a security module 170 that can limit access via the receiving module. The security module 170 can include a processor 172 and an authentication device 174. The authentication device 174 can be a scanner (e.g., an RFID reader, barcode reader, QR code reader). In some aspects, the authentication device 174 is an RFID scanner that scans an RFID tag of a package. The authentication device 174 can be a part of (or in communication with) the door 102. For example, a person delivering packages can scan the packages (e.g., scan the RFID tag, barcode, QR code, etc. on the packages) using the authentication device 174 prior to dropping the packages inside the receiving module. The processor 172 of the security module 170 can user the authentication device 174 to retrieve, access, or collect authenticating information associated with the scanned packages. The processor 172 can compare the information retrieved, accessed, or collected using the authentication device 174 with stored information associated with expected packages. The authenticating information retrieved, accessed, or collected by the processor 172 may be from the scanned package. In other words, labels or tags (for example, an RFID tag) on the packages can include such authenticating information themselves. Additionally or alternatively, such labels or tags can provide the processor 172 location information associated with a location of the authenticating information.

If the processor 172 determines that the information of the scanned packages match the information associated with expected packages, it can grant access to the receiving module 100 and allow the delivery person use the door 102 to insert the packages. If there is no match, the processor 172 can deny access and keep the door 102 locked or require additional information to grant access. The authentication device 174 can receive various information from the package such as recipient name, recipient address, tracking information, sender information, sender address, time of delivery, and the like. The security module 170 can include a communication module 176 that can transmit (e.g., with a wireless transmitter or transceiver thereof) information of the delivered package to a user of the receiving module 100 (or receiving module 100) to alert the user of the delivery and/or transmit information of the delivered package to the shipper to alert that the delivery has been completed. Such transmission of alert or notification can be transmitted wirelessly. The alert or notification can be generated by the processor 172.

It is contemplated that other suitable security modules or authentication devices and methods can be used. For example, a delivery person may provide his or her identification instead of information associated with a delivery package and such identification information may be used to authenticate the delivery.

The following description is merely illustrative in nature and is in no way intended to limit the disclosure, its application, or uses. For purposes of clarity, the same reference numbers will be used in the drawings to identify similar elements. It should be understood that steps within a method may be executed in different order without altering the principles of the present disclosure.

Conditional language used herein, such as, among others, "can," "might," "may," "for example," and the like, unless specifically stated otherwise, or otherwise understood within the context as used, is generally intended to convey that certain embodiments include, while other embodiments do not include, certain features, elements or states. Thus, such conditional language is not generally intended to imply that features, elements or states are in any way required for one or more embodiments or that one or more embodiments necessarily include logic for deciding, with or without author input or prompting, whether these features, elements or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Further, the term "each," as used herein, in addition to having its ordinary meaning, can mean any subset of a set of elements to which the term "each" is applied.

Terms such as "substantially," "about," "approximately" or the like as used in referring to a relationship between two objects is intended to reflect not only an exact relationship but also variances in that relationship that may be due to various factors such as the effects of environmental conditions, common error tolerances, manufacturing variances, or the like. It should further be understood that although some values or other relationships may be expressed herein without a modifier, these values or other relationships may also be exact or may include a degree of variation due to various factors such as the effects of environmental conditions, common error tolerances, or the like. For example, when referring to measurements, about a specified measurement can, in some contexts, refer to a measurement variation of around equal to or less than ±10%, ±5%, ±2%, or ±1% (such as a variation of ±10%, ±5%, ±2%, ±1%, ±0.8%, ±0.5%, or ±0.3%) from the specified measurement.

Although the receiving module is disclosed with reference to few various examples, the disclosure is not intended to be limited thereby. For example, the body of the receiving module may be or may not be rectangular. The body of the receiving module may be in other shapes that may allow the receiving modules suitable to receive different packages in different sizes or shapes. The door of the receiving module may not be rotatably coupled. The door may be pulled and slid out and away from the receiving module to allow delivery persons to place packages inside.

Additionally, other combinations, omissions, substitutions and modifications will be apparent to the skilled artisan in view of the disclosure herein. Accordingly, the present disclosure is not intended to be limited by the examples, but is to be defined by reference to the appended claims.

Additionally, all publications, patents, and patent applications mentioned in this specification are herein incorporated by reference to the same extent as if each individual publication, patent, or patent application was specifically and individually indicated to be incorporated by reference.

What is claimed is:

1. A modular receiving apparatus for receiving and storing delivered packages, the receiving apparatus comprising:

a body comprising a first opening;

a plurality of installation tabs coupled to the body, each of the plurality of installation tabs comprising a first plurality of openings to facilitate installation of the modular receiving apparatus, the plurality of installation tabs bendable at different locations along the plurality of installation tabs to adjust installation depth for the modular receiving apparatus; and a door coupled to the body and comprising a front shield and a rear shield, the rear shield coupled to the front shield and positioned at a first angle with respect to the front shield, the door configured to move between a first position and a second position to allow receipt of delivered goods through the first opening.

2. The receiving apparatus of claim 1, wherein the plurality of installation tabs are coupled to side panels of the body.

3. The receiving apparatus of claim 1, wherein the first plurality of openings are circular or elongated.

4. The receiving apparatus of claim 1, wherein each of the first plurality of openings is positioned at a predetermined distance from adjacent openings of the first plurality of openings.

5. The receiving apparatus of claim 1, wherein each of the plurality of installation tabs comprise a second plurality of openings.

6. The receiving apparatus of claim 5, wherein the first plurality of openings are formed at a center longitudinal axis of the plurality of installation tabs and the second plurality of openings are offset from the center longitudinal axis of the plurality of installation tabs.

7. The receiving apparatus of claim 5, wherein the first plurality of openings are positioned at a first predetermined distance apart from each other, and the second plurality of openings are positioned at a second predetermined distance apart from each other.

8. The receiving apparatus of claim 7, wherein the first predetermined distance and the second predetermined distance are the same.

9. The receiving apparatus of claim 1, wherein the plurality of installation tabs are configured to be bent such that the first plurality of openings are positioned against a surface for installation.

10. The receiving apparatus of claim 1, wherein, position, the rear shield is positioned at a second angle with respect to the first opening to prevent access beyond the rear shield when the door is in the second position.

11. The receiving apparatus of claim 1, wherein each the plurality of installation tabs comprise a plurality of cutouts positioned along edges of the each of the plurality of installation tabs.

12. The receiving apparatus of claim 11, wherein the plurality of cutouts facilitate bending of the installation tabs.

13. The receiving apparatus of claim 11, wherein the plurality of cutouts are positioned at a predetermined distance apart from each other.

14. The receiving apparatus of claim 1, further comprising an authentication module comprising:

a processor;

a storage device; and an authentication device, wherein the processor is configured collect authenticating information associated with packages to be delivered using the authentication device.

15. The receiving apparatus of claim 14, wherein:

the storage device stores a set of information associated with expected packages;

the processor is configured to compare the authenticating information with the set of information associated with expected packages;

upon determination that the authenticating information matches the set of information associated with expected packages, the processor is configured to unlock the door to allow the door to be moved between the first position and the second position; and upon determination that the authenticating information does not match the set of information associated with expected packages, the processor is configured to prevent the door from moving between the first position and the second position.

16. The package receiving container of claim 15, wherein the container comprises:

a first compartment;

a second compartment physically separated and thermally insulated from the first compartment; and a temperature control unit configured to generate heat for the first compartment and remove heat from the second compartment.

17. The package receiving container of claim 16, further comprising an authentication module comprising:

a processor;

a storage device; and an authentication device, wherein the processor is configured collect authenticating information associated with delivered packages using the authentication device.

18. The receiving apparatus of claim 17, wherein:

the storage device stores a set of information associated with expected packages;

the processor is configured to compare the authenticating information with the set of information associated with expected packages;

upon determination that the authenticating information matches the set of information associated with expected packages, the processor is configured to unlock the door to allow the door to be moved between the first position and the second position; and upon determination that the authenticating information does not match the set of information associated with expected packages, the processor is configured to prevent the door from moving between the first position and the second position.

19. A package receiving container comprising:

a container comprising a first opening;

a body comprising a second opening and dimensioned to extend through the first opening;

a plurality of installation tabs coupled to the body, each of the plurality of installation tabs comprising a first plurality of openings, the plurality of installation tabs configured to couple the body to the container; and a door coupled to the second opening and comprising a front shield, a rear shield, and a coupling device, the coupling device rotatably coupling the door to the second opening, the rear shield positioned at a first angle with respect to the front shield, wherein:

the door is configured to rotate between a first position and a second position about the coupling device;

the front shield prevents access through the second opening when the door is in the first position; and the front shield is angularly positioned away from the second opening when the door is in the second position, allowing access through the second opening.

20. A modular receiving apparatus for receiving and storing delivered packages, the receiving apparatus comprising:

a body comprising a first opening;

a plurality of installation tabs formed on the body, each of the plurality of installation tabs comprising a first plurality of openings to facilitate installation of the modular receiving apparatus, the plurality of installation tabs bendable at different locations along the plurality of installation tabs to adjust installation depth for the modular receiving apparatus; and a door coupled to the body and comprising a front shield and a rear shield, the rear shield coupled to the front shield and positioned at a first angle with respect to the front shield, the door configured to move between a first position and a second position to allow receipt of delivered goods through the first opening.

* * * * *